United States Patent [19]

Lampman et al.

[11] Patent Number: 4,746,177

[45] Date of Patent: May 24, 1988

[54] SUPPORT ASSEMBLY FOR PLASTIC TUB DISHWASHER

[75] Inventors: William T. Lampman, St. Joseph Township, Berrien County; Mark A. Burdorff, Lincoln Township, Berrien County, both of Mich.

[73] Assignee: Whirlpool Corporation, Benton Harbor, Mich.

[21] Appl. No.: 931,623

[22] Filed: Nov. 17, 1986

[51] Int. Cl.[4] ..... A47B 77/06

[52] U.S. Cl. ..... 312/228; 248/188.8; 248/316.8

[58] Field of Search ..... 312/228, 242; 248/188, 248/188.8, 201, 316.8, 297.2, 678

[56] References Cited

U.S. PATENT DOCUMENTS

| | | | |
|---|---|---|---|
| 3,811,746 | 12/1972 | Butsch et al. | 312/228 |
| 3,826,553 | 7/1974 | Cushing et al. | 312/253 |
| 4,295,692 | 10/1981 | Jenkins | 312/228 |
| 4,359,250 | 11/1982 | Jenkins | 312/228 |
| 4,598,894 | 7/1986 | Johannes | 248/675 X |

*Primary Examiner*—Joseph Falk

*Attorney, Agent, or Firm*—Wood, Dalton, Phillips, Mason & Rowe

[57] ABSTRACT

According to the invention, a tub assembly, consisting of a tub and associated supporting frame, is provided. The tub has a front opening, a bottom wall, back wall, top wall and spaced side walls. The frame has an upwardly facing ledge for supporting the bottom tub wall and further has an upstanding leg. Structure is provided for snap-fitting the upstanding leg and a portion of the tub together so that the tub portion and leg are confined against both vertical and fore and aft relative shifting.

10 Claims, 1 Drawing Sheet

FIG. 1
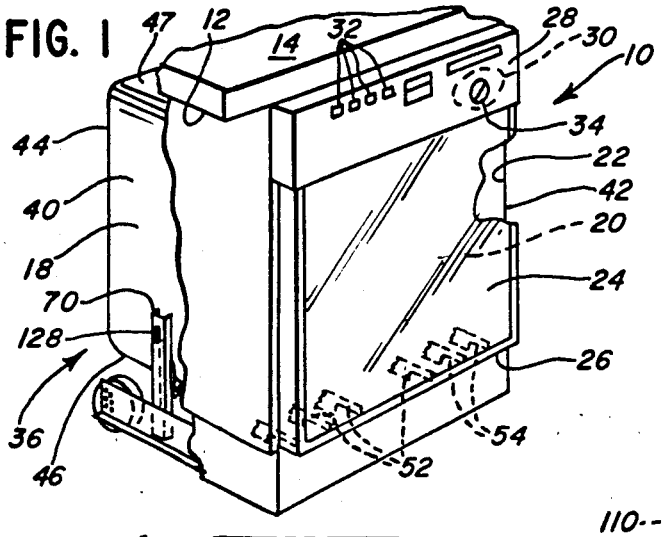
FIG. 3
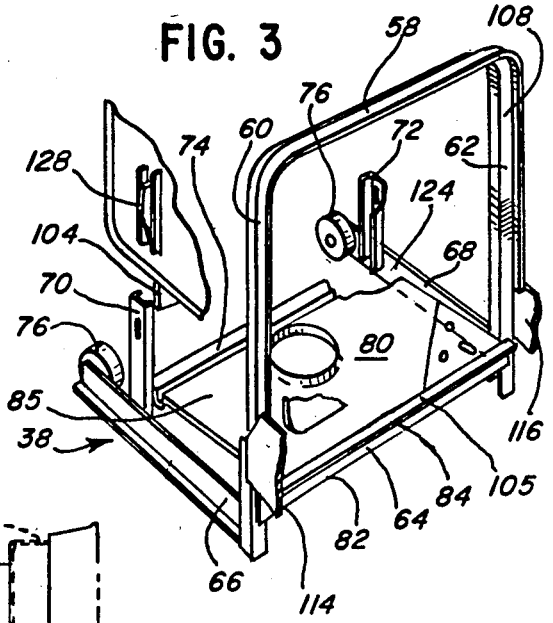
FIG. 2
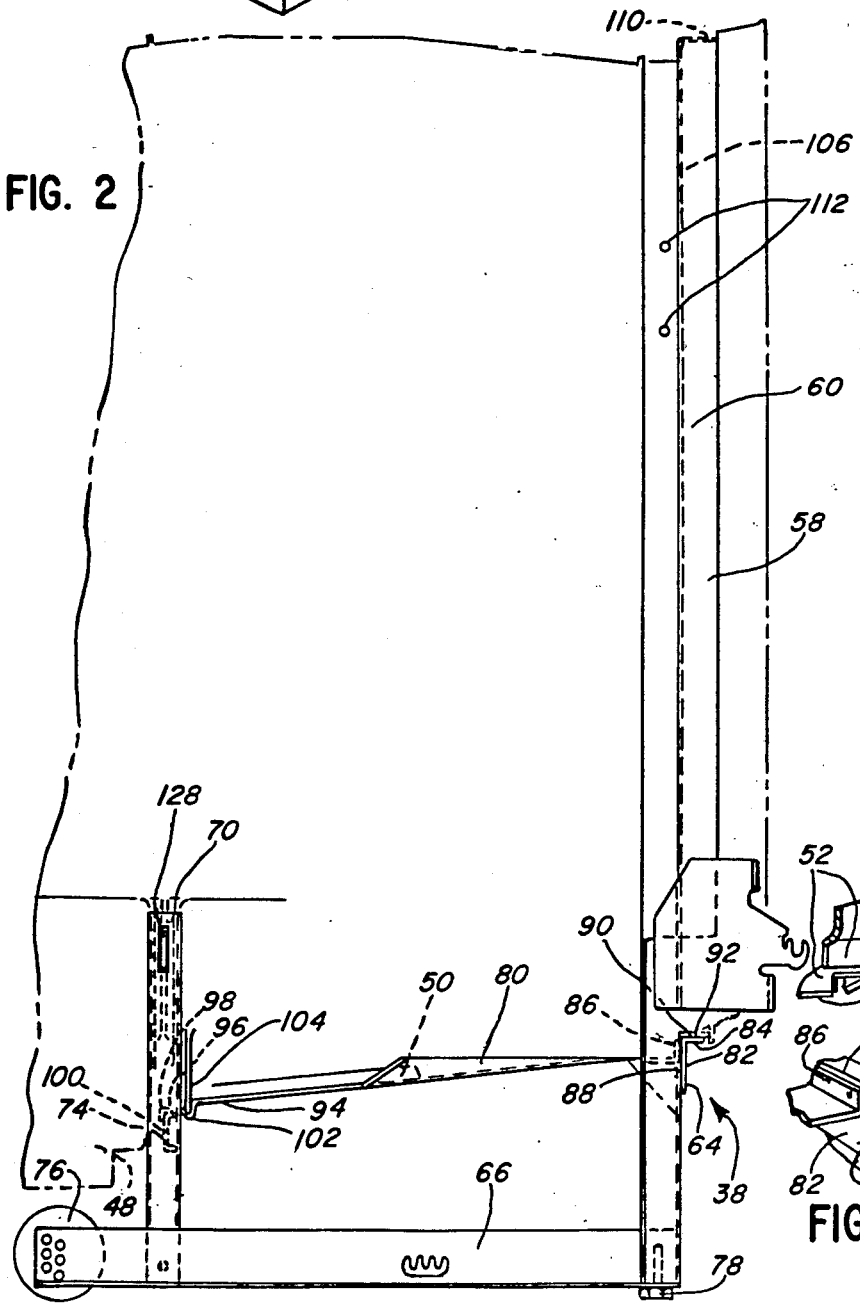
FIG. 4
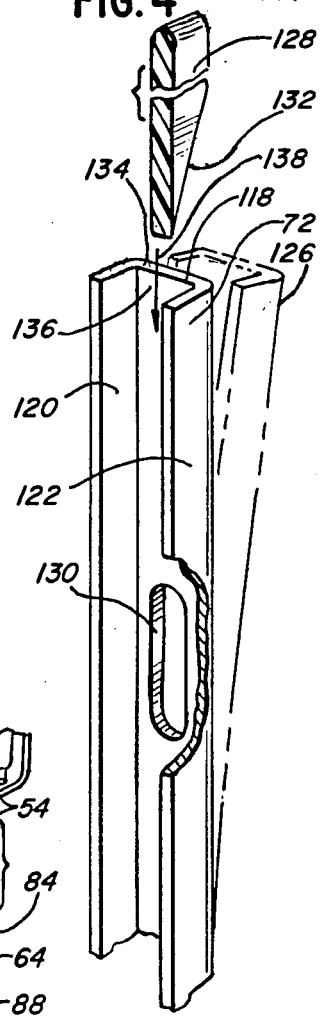
FIG. 5

SUPPORT ASSEMBLY FOR PLASTIC TUB DISHWASHER

BACKGROUND OF THE INVENTION

1. Field of the Invention

This invention relates to dishwashing apparatus and, more particularly, to structure for supporting a plastic tub.

2. Background Art

It is known to construct tubs for dishwashing apparatus from plastic, thereby minimizing the cost of manufacture and overall weight of the apparatus. Various types of framework have been devised to support the tub, which is generally molded in a single piece. To best exploit the advantages of plastic, designers have striven to simplify the supporting framework for the tub. By minimizing the frame size, one contends with the problem of tub distortion, particularly about the opening at the front of the tub through which opening access is gained to a wash chamber defined by the tub.

One exemplary frame structure is shown in U.S. Pat. No. 3,826,553, to Cushing et al. Cushing et al disclose a raised platform for bearing against substantially the entire bottom wall of the tub and a wide collar that extends around the tub adjacent the front access opening.

The Cushing et al structure is quite complicated and has large supporting side plates which add considerably to the overall weight of the structure, thereby reducing the advantage of making the tub from lightweight plastic.

U.S. Pat. No. 4,295,692, to Jenkins, discloses a base upon which the tub can seat and a separate frame for surrounding and reinforcing the tub adjacent the front opening. Jenkins does not teach structure for positively joining the tub and base.

Another known prior art frame has front and rear, inverted, U-shaped collars which surround the upper portion of the tub. Frame members connect between the legs on each collar and separate frame members interconnect the collars with each other. This structure is also complicated and requires, during manufacture, performance of separate steps to connect the tub to the frame to prevent relative shifting therebetween.

SUMMARY OF THE INVENTION

The present invention is specifically directed to overcoming the above enumerated problems in a novel and simple manner. According to the invention, a tub assembly, consisting of a tub and associated supporting frame, is provided. The tub has a front opening, a bottom wall, back wall, top wall and spaced side walls. The frame has an upwardly facing ledge for supporting the bottom tub wall and further has an upstanding leg. Structure is provided for snap-fitting the upstanding leg and a portion of the tub together so that the tub portion and leg are confined against both vertical and fore and aft relative shifting.

The snap-fit connection of the frame and tub simplifies assembly and potentially eliminates framework that might otherwise be required to prevent relative shifting between the tub and frame. In a preferred form, two upstanding legs are provided on the frame, with each incorporating structure for snap-fitting to the tub.

Relative shifting of the tub and frame is further prevented by providing a cooperating, elongate rib and ridge on the tub and frame.

A further aspect of the invention is the provision of a liner plate that serves the multiple functions of shielding the mechanism below the tub with the tub removed, reinforcing the other frame members and supporting a portion of the tub.

BRIEF DESCRIPTION OF THE DRAWINGS

FIG. 1 is a perspective view of an under-the-counter style dishwasher incorporating a tub assembly according to the present invention;

FIG. 2 is a side elevation view of the tub assembly;

FIG. 3 is a perspective view of the tub assembly frame in relationship to a portion of the tub;

FIG. 4 is an enlarged, exploded, perspective view of structure for snap-fitting the tub to the frame; and FIG. 5 is a fragmentary, perspective view of cooperating supporting structure on the tub and frame at the front portion of the tub assembly.

DETAILED DESCRIPTION OF THE DRAWINGS

In FIG. 1, a dishwashing apparatus suitable for incorporation of the present invention is shown at 10. The apparatus in FIG. 1 is an under-the-counter design and is floor mounted so that the top of the apparatus 10 resides closely beneath the underside 12 of a counter 14. The dishwashing apparatus includes a tub 18 which defines a wash chamber 20, within which a plurality of racks (not shown) can be placed for supporting dishes and utensils to be washed. The tub defines a front opening 22 through which access can be gained to the wash chamber 20. The front opening can be closed by a door 24, which is hinged adjacent its lower edge 26 for selective pivoting movement between the closed position of FIG. 1 and an open position. The door 24 has an associated console 28, which houses the electrical controls for the dishwashing apparatus, including a timer mechanism 30. Operator controls 32 are carried by the console as is a knob 34, through which an operator can manually cycle the timer mechanism.

The invention, as detailed in FIGS. 1–5, resides in the tub assembly at 36, in FIG. 1, comprising the tub 18 and frame at 38. The tub 18 is molded from plastic and has laterally spaced side walls 40, 42, a rear wall 44, a bottom wall 46 and a top wall 47. The bottom wall 46 of the tub 18 declines towards the rear of the tub and has an integrally formed funnel-shaped portion 48 for recovering liquid delivered into the wash chamber 20. An opening 50 is provided in the bottom tub wall to accommodate liquid pumping structure for delivering a washing liquid into the wash chamber 20. At its forward portion, the bottom wall of the tub has integrally formed and laterally spaced ribs 52, each of which has a downwardly facing, stepped, bottom edge 54, which cooperates with the frame 38 as described below.

The frame 38 is made from metal and may be assembled by welding or preferrably by mechanical interlocked stitching and mechanical fasteners. The frame comprises a U-shaped, downwardly opening collar 58 having first and second depending legs 60, 62 respectively, a front cross member 64 connecting between the first and second legs 60, 62 at an intermediate height thereon, first and second laterally spaced side supports 66, 68 extending rearwardly from the first and second depending legs 60, 62 respectively, first and second upstanding legs 70, 72 projecting upwardly from the first and second side supports 66, 68 respectively and a rear cross member 74 connecting between the first and second upstanding legs 70, 72. Each side support 66, 68 has adjustably mounted at its rearward end a roller 76 and at its front end a vertically adjustable support pad 78. The rollers 76 and pads 78 cooperatively support the entire dishwashing apparatus, with the rollers 76 facilitating movement of the dishwashing apparatus over a supporting surface therefor.

The supports 66, 68, front cross member 64 and rear cross member 74 cooperatively bound a rectangular space which is covered by a liner plate 80. The liner plate 80 is supported cooperatively by the front and rear cross members 64, 74. The front cross member 64 has an L-shaped cross section with a vertical leg 82 and horizontal leg 84. The liner has a generally flat body 85 and at its forward portion, an upright leg 86 making substantially a right angle with the body 85 and facially abutting the rearwardly facing surface 88 on the leg 82 of the cross member 64. The liner has a horizontal leg 90 bent forwardly away from the upright leg 86 and facially overlying an upwardly facing surface 92 on the cross member 64. The liner is thus borne principally by the surface 92 on the front cross member 64.

The rear cross member 74 has a substantially rectangular cross-sectional configuration. The bottom surface 94 of the liner rests on the upwardly facing surface 96 of the cross member 74. The rear edge 98 of the liner is bent downwardly and against the rearwardly facing surface 100 on the cross member 74. Immediately forwardly of the cross member 74, the liner 80 has an integrally formed, upwardly opening, U-shaped ridge 102, extending generally laterally of the frame 38.

The tub 18 has projecting downwardly from the bottom wall 46, a laterally extending rib 104, which seats in the ridge 102 and prohibits relative fore an aft shifting of the tub and liner. With the rib 104 seated in the ridge 102, the stepped bottom edge 54 of the ribs 52 at the front of the tub seat on a laterally projecting ledge 105 defined by the upper surface of the liner leg 90 overlying the leg 84 of the cross member 64. The ribs 52 are the principal supporting means for the front of the tub and reinforce the tub at the forward portion of the bottom wall so that distortion of the tub about the front opening 22 is minimized. With the tub so seated, the collar 58 closely surrounds the forward edge 106 of the tub to maintain the shape of the opening 22. The inside surface 108 of the collar 58 has a stepped configuration, conforming to the outer peripheral surface 110 of the tub at its forward edge 106. With the tub and frame so interrelated, connection therebetween can be established as by threaded fasteners 112 extending through the collar 58 and side walls 40, 42. By securing the collar and tub, the tub is positively reinforced about the front opening 22 and the frame is rigidified to afford a suitable support for hinged connection of the door. The frame has associated plates 114, 116, to which the door 24 is pivotally attached.

Fixed connection of the rear portion of the tub is established by cooperating structure on the tub and frame for snap-fitting the upstanding legs 70, 72 to the tub side walls 40, 42. The connection of each of the legs 70, 72 to the tub is accomplished in the same manner and thus discussion herein will be limited to exemplary leg 72.

The leg 72 has a U-shaped cross section with a web 118 and associated spaced legs 120, 122. The web is secured as by welding to a flat wall surface 124 on the side support 68 so that the legs 120, 122 open inwardly towards the tub. The leg 72, connected at its bottom portion to leg 68 and midway along its length to rear cross member 74, has some flexibility along its length so that it can be bent slightly outwardly at its upward portion 126. Further, the frame 38 has, by reason of its construction, some inherent flexibility. For example, side suport 68 can be slightly twisted about its length. The twisting of side support 68 principally accounts for the ability of the upward portion 126 of the leg to be bent outwardly as shown in phantom in FIG. 4. This flexibility is required to allow a lug 128 having a lower sloped surface 132 to be introduced into a correspondingly configured recess 130 in the web 118 on the leg 72.

The lug 28 is integrally formed with each of the side walls of the tub. These lugs are preferably at corresponding locations on their respective side walls so that they cooperate in camming the legs 70, 72 away from each other as the tub is lowered onto the frame. As the tub is assembled, the sloped surface or leading edge 132 on the bottom of each lug encounters the top free edge 134 of the legs 70, 72. The edges 132 guide the lugs onto the inwardly facing web surface 136 and as this occurs the legs flex outwardly progressively as the lugs move downwardly in the direction of arrow 138 towards their associated, cooperating recesses. At the same time the side walls 40, 42 bow inwardly, the outward flex of the legs and the inward bow of the sides cooperate to allow the lugs to 128 align with the recesses 130. Then the legs 70, 72 and the sides 40, 42 spring back so that the lugs 128 are captured in the recesses 130. To remove the tub, the legs 70, 72 must be manually bent laterally outwardly away from each other to allow the lugs 128 to be withdrawn from the recesses.

It can be seen that the frame and tub can be simply joined to each other so that the frame positively supports the tub and relative movement between the tub and frame is effectively prevented. The snap-fit connection between the legs 70, 72 and tub facilitates joining of the tub and frame.

The foregoing disclosure of specific embodiments is intended to be illustrative of the broad concepts comprehended by the invention.

We claim:

1. A tub assembly for a dishwashing apparatus, said tub assembly comprising:

a flexible tub defining a wash chamber and having a front opening, a bottom wall, a back wall, a top wall, spaced side walls, and laterally oppositely projecting first and second lugs on the tub side walls, each said lug having a free edge;

a frame having (a) an upwardly facing ledge for supporting a first portion of the tub;

(b) a collar for extending around the side walls and top wall of the tub with the tub in assembled relationship with the frame;

(c) first and second, laterally spaced, upstanding leg members at the rear of the frame for engagement with the side walls of the flexible tub, said first and second upstanding leg members having facing surfaces spaced apart a distance less than the spacing between the free edges of the laterally projecting lugs, there being a lug-receiving opening in each of the facing surfaces of the upstanding legs at a top portion thereof;

(d) first and second elongate side supports each extending between the collar and one of the first and second upstanding legs and twistable about its length;

(e) means mounting the first upstanding leg member to the first side support so that the lug-receiving opening in the first upstanding leg member aligns with the first lug with the tub and frame assembled and so that the top portion of the first upstanding leg member can be flexed laterally outwardly by twisting the first side support about its length; and (f) means mounting the second upstanding leg member to the second side support so that the lug-receiving opening on the second upstanding leg member aligns with the second leg with the tub and frame assembled and so that the top portion of the second upstanding leg member can be flexed laterally outwardly by twisting the second side support about its length, whereby said tub and frame can be snap connected to each other by urging the first and second lugs downwardly against the first and second upstanding leg members thereby flexing the top portions of the first and second upstanding leg members from an unflexed state away from each other to thereby permit seating of the first and second lugs in the lug-receiving openings and movement of the top portion of the first and second upstanding leg members back to their unflexed state to lock the tub and frame together in assembled relationship.

2. The tub assembly according to claim 1 wherein said collar has first and second laterally spaced, vertically extending legs, a cross member connects between the vertically extending collar legs and defines the upwardly facing ledge and the tub has at least one rib on a forward portion thereof with a downwardly facing edge for bearing on the ledge.

3. The tub assembly according to claim 1 wherein said frame has a liner plate, said liner plate has a laterally extending ridge that is substantially U-shaped in cross-section and opens upwardly and the tub has on its bottom wall a downwardly projecting rib which seats in the ridge and prevents fore and aft shifting of the tub relative to the frame.

4. The tub assembly according to claim 1 wherein the tub is made from plastic.

5. The tub assembly according to claim 1 wherein each said first and second upstanding frame leg is bendable to facilitate snap connecting of the tub and frame.

6. A tub assembly for a front loading dishwasher to be supported on a generally flat supporting surface, said tub assembly comprising:

a flexible plastic tub forming a front opening and having a back wall, a top wall, spaced side walls, a bottom wall and first and second laterally oppositely projecting lugs formed integrally with the side walls, each said lug having a free edge;

a frame having (a) a collar formed in a downwardly opening U-shape having first and second depending legs, said collar engaging said tub top wall and each of said first and second depending legs engaging a tub side wall adjacent said front opening;

(b) a front cross member extending between the first and second depending legs and supporting a portion of the tub adjacent said front opening with the tub and frame assembled;

(c) first and second, laterally spaced, upstanding leg members at the rear of the frame, each of said first and second upstanding leg members engaging a portion of one of said side walls, said first and second upstanding leg members having facing surfaces spaced apart a distance less than the spacing between the free edges of the laterally projecting lugs, there being a lug-receiving opening in each of the facing surfaces of the upstanding legs at a top portion thereof;

(d) first and second elongate side supports each extending between one of the first and second depending legs and one of the first and second upstanding legs and each twistable about its length;

(e) means mounting the first upstanding leg member to the first side support so that the lug-receiving opening on the first upstanding leg member aligns with the first lug with the tub and frame assembled and so that the top portion of the first upstanding leg member can be flexed laterally outwardly by twisting the first side support about its length;

(f) means mounting the second upstanding leg member to the second side support so that the lug-receiving opening on the second upstanding leg member aligns with the second lug with the tub and frame assembled and so that the top portion of the second upstanding leg member can be flexed laterally outwardly by twisting the second side support about its length; and (g) means interconnecting the first and second upstanding leg members to each other, whereby said tub and frame can be snap connected to each other by urging the first and second lugs downwardly against the first and second upstanding leg members thereby flexing the top portions of the first and second upstanding leg members from an unflexed state away from each other to thereby permit seating of the first and second lugs in the lug-receiving openings and movement of the top portion of the first and second upstanding leg members back to their unflexed state to lock the tub and frame together in assembled relationship:

7. The tub assembly according to claim 6 wherein the first and second depending legs extend downwardly beyond the tub bottom wall and the front cross member extends between the first and second depending legs and supports a portion of the bottom wall of the tub.

8. The tub assembly according to claim 7 wherein a rear cross member extends between the first and second upstanding leg members and supports a portion of the bottom wall of the tub.

9. The tub assembly according to claim 6 wherein a rear cross member extends between the first and second upstanding leg members and a liner plate extends between and is supported by the front and rear cross members and supports a portion of the bottom wall of the tub.

10. The tub assembly according to claim 6 wherein said first and second upstanding legs do not extend upwardly as high as the top wall of the tub.

* * * * *